US008622605B2

(12) United States Patent
Asogawa

(10) Patent No.: US 8,622,605 B2
(45) Date of Patent: Jan. 7, 2014

(54) FLUID MIXING DEVICE

(75) Inventor: Minoru Asogawa, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 13/304,542

(22) Filed: Nov. 25, 2011

(65) Prior Publication Data

US 2013/0135960 A1 May 30, 2013

(51) Int. Cl.
*B01F 15/02* (2006.01)

(52) U.S. Cl.
USPC ..... 366/177.1; 366/152.1; 366/182.4; 137/597; 137/599.03; 137/897

(58) Field of Classification Search
CPC ..... B01F 15/02
USPC ..... 137/111, 597, 599.03, 897; 366/152.1, 366/177.1, 182.4
See application file for complete search history.

(56) References Cited

U.S. PATENT DOCUMENTS

| | | | | |
|---|---|---|---|---|
| 2,581,855 | A * | 1/1952 | Griffith | 137/98 |
| 2,921,719 | A * | 1/1960 | Bateman | 222/135 |
| 3,187,765 | A * | 6/1965 | Frank et al. | 137/253 |
| 3,592,213 | A * | 7/1971 | Smith | 137/98 |
| 3,604,456 | A * | 9/1971 | Jones | 137/594 |
| 5,205,322 | A * | 4/1993 | Merick et al. | 137/597 |
| 7,036,686 | B2 * | 5/2006 | Newton | 222/129.1 |
| 7,201,178 | B2 * | 4/2007 | Gupta et al. | 137/1 |
| 7,562,672 | B2 * | 7/2009 | Nakashima et al. | 137/240 |
| 7,748,400 | B2 * | 7/2010 | Nakashima et al. | 137/209 |
| 8,118,050 | B1 * | 2/2012 | Wiederin | 137/93 |
| 2012/0018228 | A1 * | 1/2012 | Spreckelmeyer | 175/107 |

FOREIGN PATENT DOCUMENTS

| | | |
|---|---|---|
| JP | 2002-527250 | 8/2002 |
| JP | 2003-139660 | 5/2003 |
| JP | 2003-139662 | 5/2003 |
| JP | 2003-190751 | 7/2003 |
| JP | 2005-345463 | 12/2005 |
| JP | 2006-142448 | 6/2006 |
| JP | 2006-247533 | 9/2006 |
| JP | 2006-247534 | 9/2006 |
| JP | 2007-187616 | 7/2007 |

* cited by examiner

*Primary Examiner* — David Sorkin
*Assistant Examiner* — Abbas Rashid
(74) *Attorney, Agent, or Firm* — Young & Thompson

(57) ABSTRACT

A fluid mixing device is productive, maintainable and improved in operability and reliability even without high accuracy pressure control. A fluid mixing device includes a mixing tank, supply tanks, mixing tank flow channels, valves, and branch flow channels. The mixing tank mixes at least two liquids. Each supply tank is provided for each of the liquids and supplies each liquid to the mixing tank. Each mixing tank flow channel connects each supply tank to the mixing tank. Each valve is arranged in each of the mixing tank flow channels. Each branch flow channel is connected to each of the mixing tank flow channels and is connected from the one mixing tank flow channel to the valve in the other mixing tank flow channel. Further, when the valve has pressure applied thereto from the liquid passing through the branch flow channel, the valve closes the mixing tank flow channel.

16 Claims, 5 Drawing Sheets

FLUID MIXING DEVICE

BACKGROUND OF THE INVENTION

1. Field of the Invention

The present invention relates to a fluid mixing device used for a gene analysis and the like and, in particular, to a fluid mixing device constructed as a micro chip.

2. Description of the Related Art

In a field referred to as a μTAS (Total Analysis System), a flow channel and a storage tank are formed in a substrate made of glass or plastics (hereinafter referred to as "micro chip") and a sample or a reagent is tested or analyzed by treating the sample or the reagent in the flow channel and the storage tank.

When the sample or the reagent is tested or analyzed by the use of the micro chip, the sample or the reagent is supplied to the flow channel and the storage tank of the micro chip from the outside of the micro chip. Further, the sample or the reagent supplied to the flow channel and the storage tank has pressure applied thereto from the outside of the micro chip, whereby the flow of the sample or the reagent is controlled and the treatment of stirring or mixing the sample or the reagent is performed.

In order to apply pressure to the sample or the reagent from the outside of the micro chip, the micro chip, a unit for supplying pressure for controlling an operation, and a unit for supplying a sample or a reagent are connected to each other by a tube or the like (see JP 2005-345463 A (patent document 1) and JP 2007-187616 A (patent document 2)).

FIG. 1 is a schematic view of a related micro chip mixing first liquid 1*a* that includes a sample or a reagent to be tested or analyzed with second liquid 1*b* that is different from first liquid 1*a*.

As shown in FIG. 1, the micro chip has first supply tank 2*a* for supplying first liquid 1*a* and second supply tank 2*b* for supplying second liquid 1*b* that is different from first liquid 1*a*. Further, in the micro chip is formed mixing tank 9 for mixing first liquid 1*a* with second liquid 1*b*.

Furthermore, the micro chip is provided with first mixing tank flow channel 3*a* for feeding first liquid 1*a* from first supply tank 2*a* to mixing tank 9, and at a position different from a position where first mixing tank flow channel 3*a* is formed, the micro chip is provided with second mixing tank flow channel 3*b* connecting second supply tank 2*b* to mixing tank 9. First supply tank 2*a* and second supply tank 2*b* are connected respectively to a liquid supply unit (not shown) supplying liquid and a pressure supply unit (not shown) supplying pressure for controlling an operation through a tube.

When pressure applied to first liquid 1*a* in first supply tank 2*a* is increased, first liquid 1*a* is fed to mixing tank 9 through first mixing tank flow channel 3*a*. In the case where the amount of first liquid 1*a* that is fed is more than an allowance of mixing tank 9 or in the case where vibration is applied to the micro chip, first liquid 1*a* is fed to second supply tank 2*b* through second mixing tank flow channel 3*b* that is connected to mixing tank 9 and that is different from first mixing tank flow channel 3*a*. Second supply tank 2*b* is supplied with second liquid 1*b*, so that first liquid 1*a* is mixed with second liquid 1*b* in second supply tank 2*b*.

Depending on the purpose of the test or the analysis, there is a case where the mixing of first liquid 1*a* with second liquid 1*b* in a place other than mixing tank 9 is not allowed. Thus, second mixing tank flow channel 3*b* is provided with second valve 5*b* preventing first liquid 1*a* fed to mixing tank 9 from flowing toward second supply tank 2*b* through second mixing tank flow channel 3*b*.

Further, similarly, first mixing tank flow channel 3*a* is also provided with first valve 5*a* preventing second liquid 1*b* from flowing toward first supply tank 2*a* from mixing tank 9 through first mixing tank flow channel 3*a*. In this way, by appropriately providing respective mixing tank flow channels 3*a*, 3*b* with first valve 5*a* and second valve 5*b*, it is possible to prevent first liquid 1*a* from mixing with second liquid 1*b* in a place other than mixing tank 9.

As the valve preventing the flow from the mixing tank to the supply tank as described above, there is employed a passive valve utilizing flow resistance or a valve using a flexible material such as a diaphragm.

The passive valve utilizing flow resistance has a structure such that a flow channel is provided with a portion having a reduced cross-sectional area to make a flow resistance value very large, thereby making liquid flow only when the liquid is fed by pressure exceeding this flow resistance value (see JP 2003-190751 A (patent document 3) and JP 2006-142448 A (patent document 4)).

In the example of the related micro chip shown in FIG. 1, a case where passive valves are employed as first and second valves 5*a*, 5*b* will be described.

In the case where first liquid 1*a* is fed from first supply tank 2*a* to mixing tank 9 through first mixing tank flow channel 3*a*, pressure exceeding the flow resistance value of first valve 5*a* is applied to first liquid 1*a* in first supply tank 2*a*. As a result, first liquid 1*a* passes through first valve 5*a*. First liquid 1*a* is fed to mixing tank 9 in the state where the pressure of first liquid 1*a* is reduced by first valve 5*a*.

In the case where the amount of first liquid 1*a* that is fed exceeds the allowance of mixing tank 9, first liquid 1*a* is fed from mixing tank 9 toward second supply tank 2*b* for supplying second liquid 1*b* through second mixing tank flow channel 3*b*. When the pressure of first liquid 1*a* at second valve 5*b* is less than the flow resistance value of second valve 5*b*, first liquid 1*a* is stopped at second valve 5*b*. Thus, first liquid 1*a* is not fed from mixing tank 9 toward second supply tank 2*b*.

In the case where a passive valve is used as a valve preventing a flow from a mixing tank to a supply tank, the passage of liquid through the valve is controlled only by the pressure of the liquid. This eliminates the need for providing a physical force or an electric signal for opening or closing the valve from the outside of the micro chip, which results in providing an advantage of easing the handling of the micro chip.

In a valve using a flexible material such as a diaphragm, the flexible material is deformed by the physical force or the electric signal provided from the outside of the micro chip to thereby open or close a flow channel.

In the example of the related micro chip shown in FIG. 1, a case will be described in which valves using a flexible material are employed as first valve 5*a* and second valve 5*b*.

In the case where first liquid 1*a* is fed from first supply tank 2*a* to mixing tank 9 through first mixing thank flow channel 3*a*, first valve 5*a* is opened and second valve 5*b* is closed by a physical force or an electric signal provided from the outside of the micro chip. Thus, even in the case where the amount of first liquid 1*a* that is fed exceeds the allowance of mixing tank 9, the feed of first liquid 1*a* from mixing tank 9 to second supply tank 2*b* is stopped by second valve 5*b*. As a result, the feed of first liquid 1*a* to second supply tank 2*b* can be prevented.

In the case where the valve preventing the flow from the mixing tank to the supply tank is formed of a flexible material, the flow channel is opened or closed by deformation of the flexible material. This can reduce the possibility that the liquid leaks from the valve and hence can provide high reliability in the control of liquid (see JP 2003-139660 A (patent document 5) and JP 2003-139662 A (patent document 6)).

In the above example, description has been made on the assumption that as a method for controlling liquid in a supply tank, the feed of the liquid is not controlled but the pressure of the liquid is controlled. In addition to controlling the pressure of the liquid, controlling the liquid can be also performed by the amount of liquid that is fed by the use of a syringe pump or the like capable of controlling the amount of liquid that is fed in the supply tank. Even if the syringe pump is used, the amount of liquid that is fed and the capacities of the flow channel, the supply tank, and the mixing tank cannot be sufficiently controlled, so that it is surely thought that the amount of liquid that is fed to the mixing tank exceeds the allowance of the mixing tank to thereby cause the flow of the liquid from the mixing tank to the supply tank. Thus, even in the case where a flow rate is controlled by the use of the syringe pump or the like, a valve is required.

In the related micro chip shown in FIG. 1, in the case where a valve preventing the flow from the mixing tank to the supply tank is constructed by the use of a passive valve, the pressure of first liquid 1*a* needs to be equal to or more than a flow resistance value of first valve 5*a* and to be less than a flow resistance value of second valve 5*b*. In other words, this requires high accuracy pressure control and may reduce the operability of the micro chip.

In the case where the control of pressure to be applied to first liquid 1*a* does not satisfy a required accuracy, there is a possibility that the pressure of first liquid 1*a* is insufficient for the flow resistance value of first valve 5*a* or exceeds the flow resistance value of second valve 5*b*. In other words, there is a possibility that feeding the liquid to mixing tank 9 and preventing the flow of the liquid to the second supply tank 2 are not normally performed to thereby reduce the reliability of the micro chip.

Further, in the case where the valve that prevents the flow of the liquid from the mixing tank to the supply tank is constructed of a flexible material, there is a need to provide an external mechanism applying a force to the flexible material from the outside of the micro chip. Thus, the connection of the external mechanism to the micro chip is increased to thereby make the handling of the micro chip cumbersome, which may reduce productivity. Further, since the external mechanism is newly provided, there is also presented a problem in which the maintenance and the inspection of the external mechanism are newly required.

SUMMARY OF THE INVENTION

Therefore, the object of the present invention is to provide a fluid mixing device that includes a valve that prevents a flow from a mixing tank to a supply tank and that is not reduced in productivity and maintainability and is improved in operability and reliability even if high accuracy pressure control is not used.

In order to achieve the object described above, a fluid mixing device of the present invention includes a mixing tank, a plurality of supply tanks, mixing tank flow channels, valves, and branch flow channels. The mixing tank mixes at least two liquids. Each of the supply tanks is provided for each of the at least two liquids and supplies each liquid to the mixing tank. Each of the mixing tank flow channels connects each of the supply tanks to the mixing tank. Each of the valves is arranged in each of the mixing tank flow channels. Each of the branch flow channels is connected to each of the mixing tank flow channels and is connected from the one mixing tank flow channel to the valve in the other mixing tank flow channel. Further, when the valve has pressure applied thereto from the liquid having passed through the branch flow channel, the valve closes the mixing tank flow channel.

According to the construction described above, before the liquid passes through one mixing tank flow channel and is fed to the mixing tank, the liquid passes through the branch flow channel and is fed to the valve provided in the other mixing tank flow channel, and the valve closes the other mixing tank flow channel. Thus, this construction can prevent the liquid from flowing from the mixing tank to the other mixing tank flow channel.

The valve that prevents the flow from the mixing tank to the mixing tank flow channel is physically closed by the liquid, so that as compared with a passive valve using utilizing flow resistance, the valve can prevent the flow from the mixing tank to the mixing tank flow channel by a lower accuracy pressure control, which can improve operability and reliability. Further, the valve is opened or closed by the liquid in the fluid mixing device, so that it is not necessary to provide a mechanism operating the valve from the outside of the fluid mixing device, which can make it simple to connect the micro chip to an external mechanism and hence can improve productivity and maintainability.

According to the fluid mixing device of the present invention, the fluid mixing device includes a valve that prevents the flow from the mixing tank to the supply tank and is not reduced in productivity and maintainability and is improved in operability and reliability even if high accuracy pressure control is not used.

The above and other objects, features and advantages of the present invention will become apparent from the following description with reference to the accompanying drawings which illustrate examples of the present invention.

DETAILED DESCRIPTION OF THE EXEMPLARY EMBODIMENT

Figure 1:
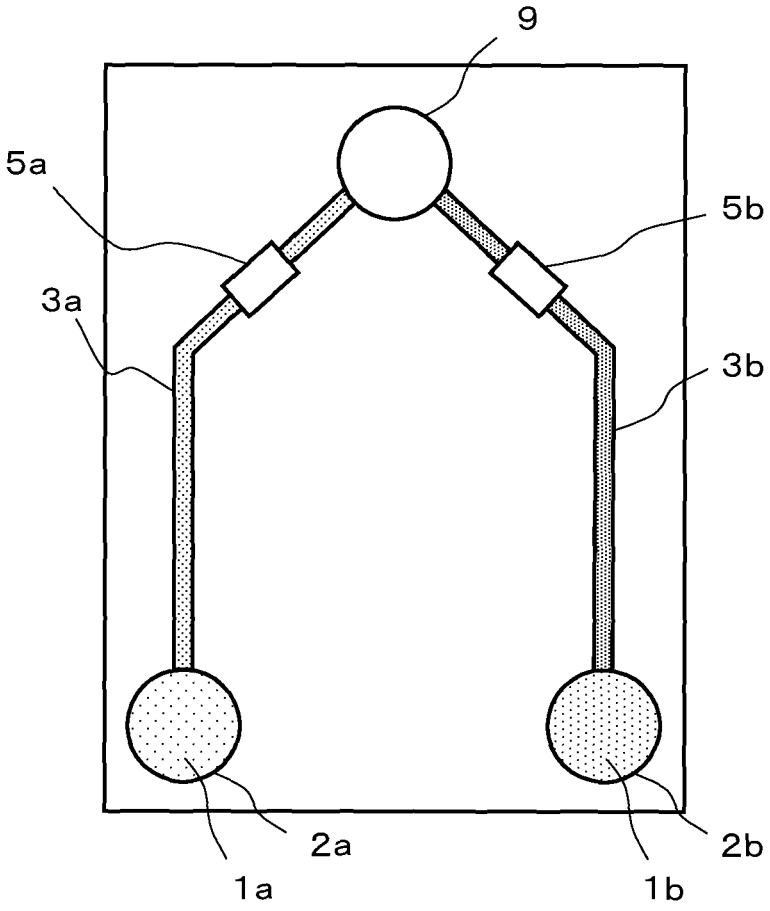
Fig.1 Prior Art
FIG. 1 is a schematic view of a related micro chip.
Figure 2:
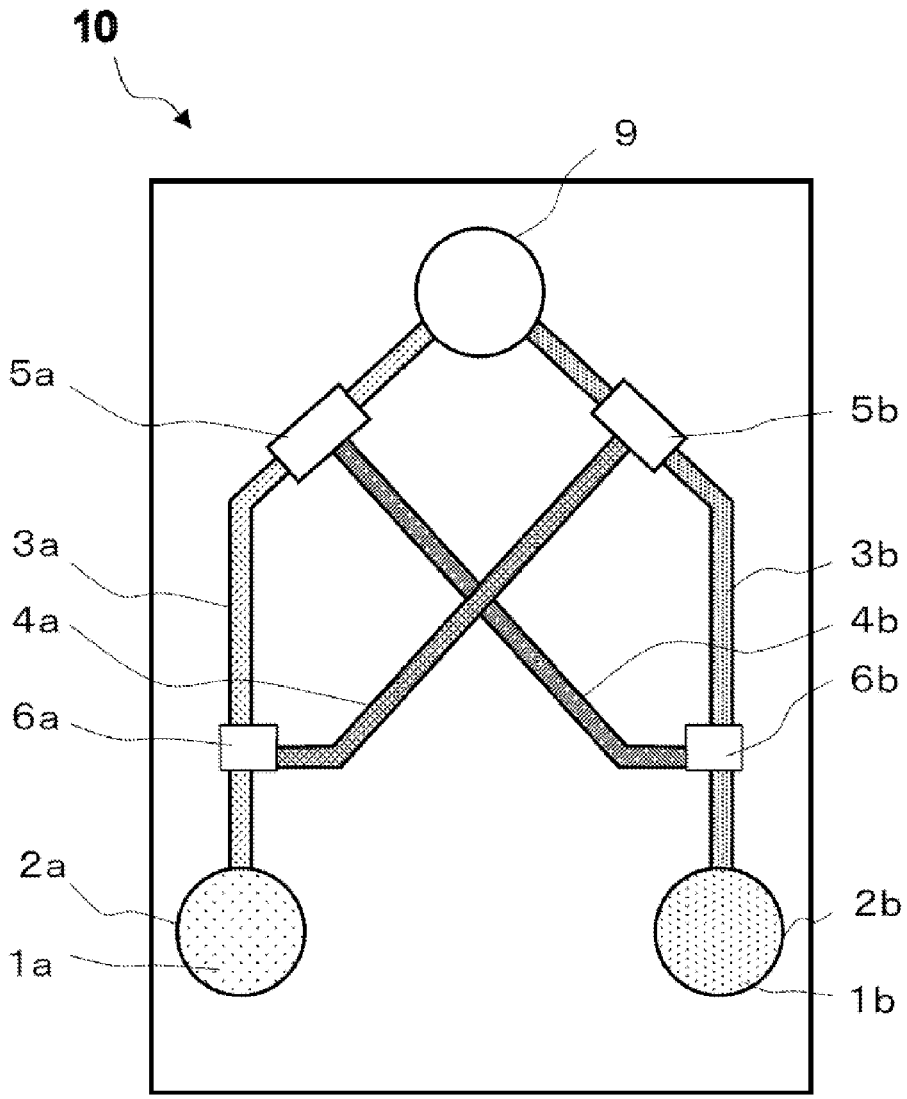
FIG. 2 is a schematic view of a micro chip in an exemplary embodiment of the present invention.

An exemplary embodiment of the present invention will be described in detail with reference to drawings. FIG. 2 is a schematic view of micro chip 10 in an exemplary embodiment of the present invention. Micro chip 10 is a chip that mixes first liquid 1*a* such as a sample or a reagent, which is an object to be tested or analyzed, with second liquid 1*b*, which is different from first liquid 1*a*, in mixing tank 9. In micro chip 10, first liquid 1*a* is fed to mixing tank 9 and then second liquid 1*b* is fed to mixing tank 9.

Micro chip 10 has first supply tank 2*a* for supplying first liquid 1*a* and second supply tank 2*b* for supplying second liquid 1*b*. Further, micro chip 10 has first mixing tank flow channel 3*a* for feeding first liquid 1*a* from first supply tank 2*a* to mixing tank 9 and has second mixing tank flow channel 3*b* connecting second supply tank 2*b* to mixing tank 9 at a position different from a position where first mixing tank flow channel 3*a* is provided. First supply tank 2*a* is connected to a liquid supply unit (not shown) supplying first liquid 1*a* from the outside of micro chip 10 and to a pressure supply unit (not shown) that increases the pressure of first liquid 1*a* by a tube or the like. Similarly, second supply tank 2*b* is also connected to a pressure supply unit and the like.

Furthermore, in first mixing tank flow channel 3*a* is arranged first valve 5*a* that prevents a flow from mixing tank 9 to first supply tank 2*a*, and similarly, in the second mixing tank flow channel 3*a* is arranged second valve 5*b* that prevents a flow from mixing tank 9 to second supply tank 2*b*.

First valve 5*a* is connected to second branch flow channel 4*b* branched from second mixing tank flow channel 3*b* between second valve 5*b* and second supply tank 2*b*. First valve 5*a* is constructed in a closing structure by a flexible material such as a diaphragm. When first valve 5*a* has pressure applied thereto from second liquid 1*b* fed through second branch flow channel 4*b*, first valve 5*a* is deformed, whereby the communication between mixing tank 9 and first mixing tank flow channel 3*a* is blocked.

Similarly, second valve 5*b* is connected to first branch flow channel 4*a* branched from first mixing tank flow channel 3*a* between first valve 5*a* and first supply tank 2*a*. When first liquid 1*a* passes through first branch flow channel 4*a* and flows into second valve 5*b*, communication between mixing tank 9 and second mixing tank flow channel 3*b* is blocked.

Furthermore, first flow channel selection mechanism 6*a* that selects a flow channel through which a flowing-in liquid is made to pass by the pressure of the flowing-in liquid is arranged at a branch point between first mixing tank flow channel 3*a* and first branch flow channel 4*a*. Similarly, second flow channel selection mechanism 6*b* is arranged at a branch point between second mixing tank flow channel 3*b* and second branch flow channel 4*b*.

Here, the concrete construction of first flow channel selection mechanism 6*a* and second flow channel selection mechanism 6*b* will be described. The flow channel selection mechanism has one input flow channel corresponding to a flow channel portion that communicates with a supply tank side of a mixing tank flow channel and a plurality of output flow channels corresponding to flow channel portions that communicate with a mixing tank side of the mixing tank flow channel and with a branch flow channel, respectively. Further, the flow channel selection mechanism has passive valves arranged in the respective output flow channels, the passive valves being different form each other in flow resistance value.

Figure 3:
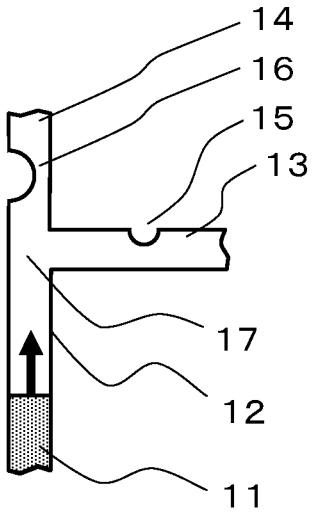
FIG. 3 is a schematic view to illustrate a flow channel selection mechanism.

FIG. 3 is a schematic view to illustrate a flow channel selection mechanism. As shown in FIG. 3, input flow channel 12 is branched into output flow channel 13 and output flow channel 14 at connection portion 17. Output flow channel 13 includes passive valve 15 having a specified flow resistance value X. Output flow channel 14 includes passive valve 16 having a flow resistance value Y larger than the flow resistance value X of passive valve 15.

Thus, if the pressure of liquid 11 fed to input flow channel 12 is less than the flow resistance value X, liquid 11 does not pass through passive valve 15 and passive valve 16. If liquid 11 has a pressure that is the flow resistance value X or more and that is less than the flow resistance value Y, liquid 11 does not pass through passive valve 16 but passes through only passive valve 15. Further, when the pressure of liquid 11 to be supplied is increased and then the pressure of supplied liquid 11 reaches the flow resistance value Y or more, the supplied liquid 11 passes through passive valve 15 and passive valve 16.

As shown in FIG. 2, in first flow channel selection mechanism 6*a* provided in micro chip 10 in the exemplary embodiment of the present invention, input flow channel 12 (FIG. 3) is connected to first supply tank 2*a* side of first mixing tank flow channel 3*a*. Output flow channel 13 (FIG. 3) including passive valve 15 having a flow resistance value Xa is connected to first branch flow channel 4*a*, and output flow channel 14 (FIG. 3) including passive valve 16 having a flow resistance value Ya larger than the flow resistance value Xa is connected to mixing tank 9 side of first mixing tank flow channel 3*a*.

Similarly, in second flow channel selection mechanism 6*b*, input flow channel 12 is connected to second supply tank 2*b* side of second mixing tank flow channel 3*b*. Output flow channel 13 including passive valve 15 having a flow resistance value Xb is connected to second branch flow channel 4*b*, and output flow channel 14 including passive valve 16 having a flow resistance value Yb larger than the flow resistance value Xb is connected to mixing tank 9 side of second mixing tank flow channel 3*b*.

In this regard, there is no need to make a difference between the flow resistance values Xa, Ya of first flow channel selection mechanism 6*a* and the flow resistance values Xb, Yb of second flow channel selection mechanism 6*a*.

Next, a method for mixing first liquid 1*a* with second liquid 1*b* in mixing tank 9 of micro chip 10 will be described.

First, a method for feeding first liquid 1*a* from first supply tank 2*a* to mixing tank 9 will be described. Here, it is assumed that the pressure of second liquid 1*b* in second supply tank 2*b* is not increased by a pressure supply unit arranged outside micro chip 10.

When the means of the pressure supply unit or the like that is provided outside micro chip 10 and that is connected to micro chip 10 by a tube or the like increases the pressure of first liquid 1*a* in first supply tank 2*a*, first liquid 1*a* passes through first mixing tank flow channel 3*a* from first supply tank 2*a* and reaches first flow channel selection mechanism 6*a*. The pressure of first liquid 1*a* in first flow channel selection mechanism 6*a* is less than the flow resistance value Xa, first liquid 1*a* remains in first flow channel selection mechanism 6*a* because the pressure of first liquid 1*a* is also less than the flow resistance value Ya.

Further, the pressure supply unit gradually increases the pressure of first liquid 1*a* in first supply tank 2*a*. When the pressure of first liquid 1*a* in first flow channel selection mechanism 6*a* reaches a value that is the flow resistance value Xa or more and that is less than the flow resistance value Ya, first liquid 1*a* flows only to first branch flow channel 4*a* side from first flow channel selection mechanism 6*a* and flows to second valve 5*b*.

Second valve 5*b* connected to first branch flow channel 4*a* is deformed by the pressure of first liquid 1*a* to thereby close second mixing tank flow channel 3*b*. Further, second valve 5*b* has a closing mechanism, so that first liquid 1*a* remains in second valve 5*b*.

After deformation of second valve 5*b* by the pressure of first liquid 1*a* is finished and then the interior of second valve 5*b* is brought into a saturated state by first liquid 1*a*, the pressure supply unit further increases the pressure of first liquid 1*a* in first supply tank 2*a*. As a result, the pressure of first liquid 1*a* in first flow channel selection mechanism 6*a* reaches the flow resistance value Ya. Thus, first liquid 1*a* remaining in first flow channel selection mechanism 6*a* starts to flow to first mixing tank flow channel 3*a* side toward mixing tank 9. Then, first liquid 1*a* reaches first valve 5*a* provided in first mixing tank flow channel 3*a* from first flow channel selection mechanism 6*a*.

First valve 5*a* is a valve closing first mixing tank flow channel 3*a* by the pressure of second liquid 1*b*, which is similar to second valve 5*b*. In the assumption described above, the pressure of second liquid 1*b* in second supply tank 2*b* is not increased, so that first valve 5*a* does not close first mixing tank flow channel 3*a*. Thus, First liquid 1*a* passes through first valve 5*a* and reaches mixing tank 9.

When the amount of inflow of first liquid 1*a* becomes larger than the allowance of mixing tank 9 or vibration or the like is applied to micro chip 10 from the outside, first liquid 1*a* starts to flow from mixing tank 9 toward second supply tank 2*b* through second mixing tank flow channel 3*b*. Then, first liquid 1*a* in mixing tank 9 reaches second valve 5*b* provided in second mixing tank flow channel 3*b*.

In the process for feeding first liquid 1*a* to mixing tank 9, the pressure of first liquid 1*a* is increased, so that first liquid 1*a* flowing into second valve 5*b* works in such a way as to close second valve 5*b*. Thus, first liquid 1*a* in second mixing tank flow channel 3*b* remains in second valve 5*b*, so that first liquid 1*a* is not fed to second supply tank 2*b*.

When a sufficient amount of first liquid 1*a* is fed to mixing tank 9, the pressure supply unit decreases the pressure of first liquid 1*a* in first supply tank 2*a*.

In a state where the pressure of first liquid 1*a* is decreased to a value that is equal to or more than the flow resistance value Xa of first flow channel selection mechanism 6*a* and that is less than the flow resistance value Ya, first liquid 1*a* does not flow from first flow channel selection mechanism 6*a* to first mixing tank flow channel 3*a* but will continue to flow to first branch flow channel 4*a*. In other words, in this state, first liquid 1*a* continues to close second valve 5*b* in second mixing tank flow channel 3*b*.

When the pressure of first liquid 1*a* is decreased to a value equal to or less than the flow resistance value Xa of first flow channel selection mechanism 6*a*, first liquid 1*a* does not flow to first branch flow channel 4*a* from first flow channel selection mechanism 6*a*. Thus, second valve 5*b* opens second mixing tank flow channel 3*b*. In this way, the feeding of first liquid 1*a* to mixing tank 9 is finished.

In a case where first liquid 1*a* of the same amount as the allowance of mixing tank 9 remains in mixing tank 9, a portion of first liquid 1*a* in mixing tank 9 is discharged by another means, which will not be described here in detail, to thereby secure a space into which second liquid 1*b* different from first liquid 1*a* can flow.

Next, second liquid 1*b* in the second mixing tank 2*b* is fed to mixing tank 9. By the same procedure as a procedure for feeding first liquid 1*a* to mixing tank 9, second liquid 1*b* can be fed to mixing tank 9 without causing second liquid 1*b* or a mixture of first liquid 1*a* and second liquid 1*b* to flow from mixing tank 9 to first supply tank 2*a*.

Specifically, when the pressure of second liquid 1*b* in second supply tank 2*b* reaches a value that is equal to or more than the flow resistance value Xb of second flow channel selection mechanism 6*b* and that is less than the flow resistance value Yb, second liquid 1*b* is fed to first valve 5*a* through second branch flow channel 4*b*. As a result, first valve 5*a* closes first mixing tank flow channel 3*a*.

Thereafter, when the pressure of second liquid 1*b* is further increased and reaches more than the flow resistance value Yb of second flow channel selection mechanism 6*b*, second liquid 1*b* starts to flow from second flow channel selection mechanism 6*b* toward mixing tank 9 through second mixing tank flow channel 3*b* and reaches second valve 5*b*.

Second valve 5*b* is a valve that is closed by the pressure of first liquid 1*a* flowing into second valve 5*b*. The pressure of first liquid 1*a* is decreased when the feeding of first liquid 1*a* is finished, so that second valve 5*b* is opened. Thus, second liquid 1*b* having reached second valve 5*b* passes through second valve 5*b* and is fed to mixing tank 9. As a result, second liquid 1*b* is mixed with first liquid 1*a* for the first time in mixing tank 9.

In the case where second liquid 1*b* is mixed with first liquid 1*a* and then second liquid 1*b* is further fed to mixing tank 9, whereby the allowance of mixing tank 9 is exceeded, second liquid 1*b* or the mixture of second liquid 1*b* and first liquid 1*a* passes through first mixing tank flow channel 3*a* and flows toward first supply tank 2*a*. Since first valve 5*a* in first mixing tank flow channel 3*a* is closed, the mixture stops at first valve 5*a*.

When a sufficient amount of second liquid 1*b* is fed to mixing tank 9, the pressure of second liquid 1*b* is decreased to thereby finish feeding second liquid 1*b*.

As described above, in the exemplary embodiment of the present invention, first liquid 1*a* and second liquid 1*b* are fed to mixing tank 9 by the supply of pressure to first liquid 1*a* in first supply tank 2*a* and by the supply of pressure to second liquid 1*b* in second supply tank 2*b*, whereby first liquid 1*a* is mixed with second liquid 1*b*. Further, by increasing the pressure of first liquid 1*a* and the pressure of second liquid 1*b*, the valves preventing the flow of the liquid from the mixing tank to the supply tanks are physically closed. Thus, the exemplary embodiment of the present invention does not require a pressure control of high accuracy that controls the pressure of liquid to be fed to a range that is between the upper and lower limits of the flow resistance value of the valve, the pressure control being required in the case where a passive valve is used for a valve to prevent the flow of the liquid from the mixing tank to the supply tank.

Further, in the exemplary embodiment of the present invention, the valves that prevent the flow from the mixing tank to the supply tank are opened or closed by the pressures of first liquid 1*a* and second liquid 1*b* that flow in micro chip 10, so that an operation from the outside of the micro chip is not required in order to open or close the valves. Thus, there is no need to provide a mechanism for operating the valve outside the micro chip and hence a cumbersome operation is not required when a tube is connected to the micro chip. There is no need to provide a mechanism for operating the valve, so that maintenance and inspection work can be reduced.

According to the micro chip of the exemplary embodiment of the present invention, the micro chip is provided with valves that prevent the flow from the mixing tank to the supply tank, so that even if high accuracy pressure control of is not used, productivity and maintainability are not reduced and operability and reliability can be improved.

In micro chip 10 in FIG. 2, first branch flow channel 4*a* intersects second branch flow channel 4*b*. A method for easily realizing a flow channel like this can be realized by bonding a plurality of sheets to each other, as shown in FIG. 4.

Figure 4:
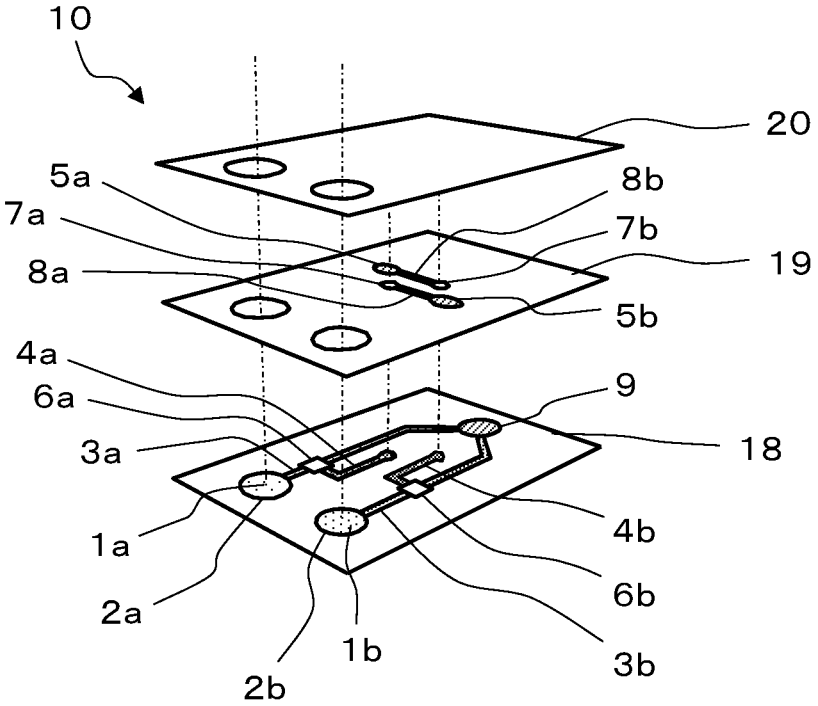
FIG. 4 is an exploded view in perspective to illustrate the construction of a micro chip in an exemplary embodiment of the present invention.

FIG. 4 is an exploded view in perspective to illustrate an exemplary embodiment of flow channels that intersect each other. As shown in FIG. 4, micro chip 10 has sheets 18, 19, 20 formed of a flexible material such as a diaphragm. Sheet 19 is laminated on sheet 18 and sheet 20 is laminated on sheet 19.

Each of the sheets is divided into portions that are bonded to the adjacent sheet and portions that are not bonded to the adjacent sheet. In FIG. 4, shaded portions are portions that are not bonded to the adjacent sheet and the liquid flows into the portions that are not bonded to the adjacent sheet. In other words, a flow channel through which the liquid flows, a tank in which the liquid is stored, and a valve closing the flow channel are formed by a structure such that a portion in which the sheets are not bonded to each other is surrounded by a portion in which the sheets are bonded to each other.

The respective constructions of the supply tank, the mixing tank flow channel, the flow channel selection mechanism, and the mixing tank that are formed on sheet 18 are the same as the respective constructions in the schematic view shown in FIG. 2, so that descriptions related to them will be omitted. Valves 5*a*, 5*b* closing the mixing tank flow channels 3*a*, 3*b* are formed on sheet 19.

At an end portion on a side opposite to a side connected to first flow channel selection mechanism 6*a* of first branch flow channel 4*a* branched from first flow channel selection mechanism 6*a*, sheet 19 arranged in the center has first hole 7*a* cut out. Thus, liquid flowing through first branch flow channel 4*a* passes through first hole 7*a* and flows between sheet 19 and sheet 20. In other words, first hole 7*a* functions as a through hole.

Further, first branch flow channel 8*a* connecting first hole 7*a* to second valve 5*b* is formed between sheet 19 and sheet 20. Thus, first liquid 1*a* passes through first flow channel selection mechanism 6*a*, branch flow channel 4*a*, first hole 7*a*, and branch flow channel 8*a* and then reaches second valve 5*b*.

Similarly, second liquid 1*b* passes through second flow channel selection mechanism 6*b*, branch flow channel 4*b*, hole 7*b*, and branch flow channel 8*b* and then reaches first valve 5*a* for closing first mixing tank flow channel 3*a*. According to the construction described above, there can be realized a micro chip in which first branch flow channel 4*a* intersects second branch flow channel 4*b*, as shown in FIG. 2.

In this regard, a non-flexible material can be also used for a portion of the three sheets 18, 19, and 20 in micro chip 10 shown in FIG. 4, if the mechanism described above can be operated even by the non-flexible material. For example, a non-flexible sheet can be also used for sheet 20.

Figure 5:
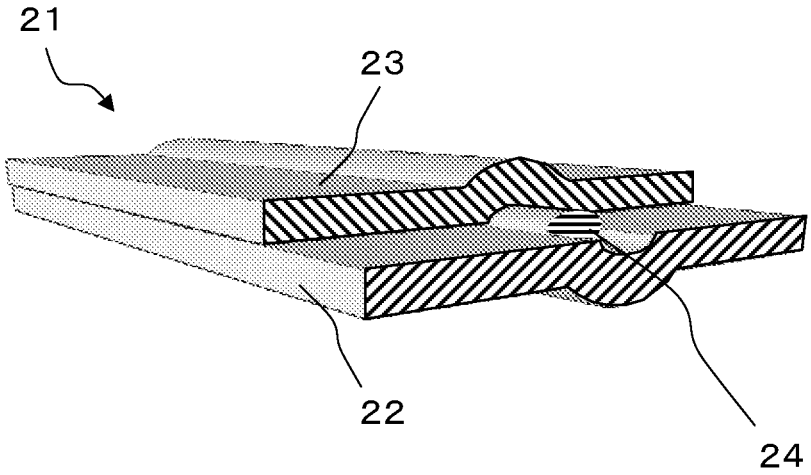
FIG. 5 is a section view of a flow channel of a micro chip.

Here, the specific construction of passive valve 15 and passive valve 16 in the flow channel selection mechanism in FIG. 3 will be described by the use of FIG. 5. FIG. 5 is a section view of a flow channel of a micro chip.

As shown in FIG. 5, in micro chip 21, sheet 22 made of a flexible material has sheet 23 laminated thereon, sheet 23 being also made of a flexible material. A portion in which sheet 22 is not bonded to sheet 23 is made flow channel 24. In FIG. 5 is shown a state where liquid is introduced into micro chip 21 from the outside and where the pressure of the liquid is held at a specified value.

Figure 6:
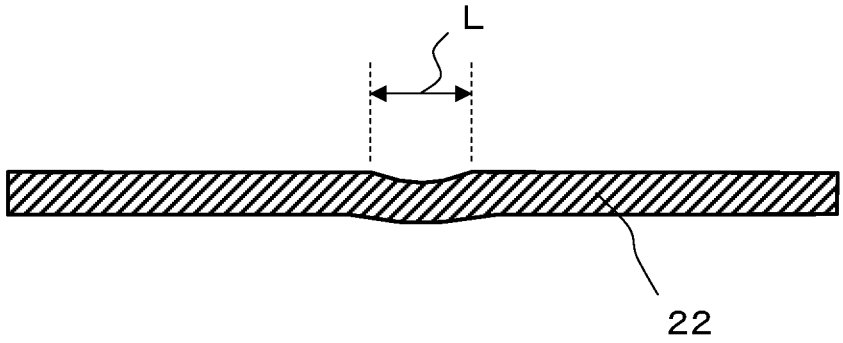
FIG. 6 is a section view when the deformation of a sheet of a micro chip is simulated by the use of FEM.

FIG. 6 is a section view when the deformation of sheet 22 is simulated by the use of FEM (Finite Element Method). When it is assumed that the flow channel width L of micro chip 21 is 500 μm and that the thickness of micro chip 21 is 200 μm, the deformation of sheet 22 or sheet 23 in the state where flow channel 24 is encapsulated with liquid and where pressure is applied to the liquid is simulated by the use of FEM. The deformation of sheet 22 is vertically symmetric to the deformation of sheet 23, so that only sheet 22 is shown in FIG. 6.

Figure 7:
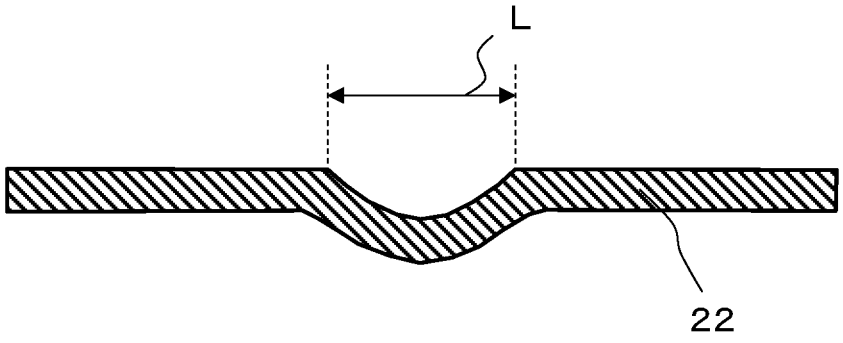
FIG. 7 is a section view when the deformation is simulated with a flow channel width changed in FIG. 6.

Further, FIG. 7 is a section view when the deformation of sheet 22 is simulated by the use of FEM, which is similar to FIG. 6. In the example shown in FIG. 7, it is assumed that the flow channel width L is 1000 μm. The conditions other than the flow channel width L in the simulation are the same as those in the example shown in FIG. 6.

When FIG. 6 is compared with FIG. 7, although the same pressure is applied to the liquid in flow channel 24, the deformation of sheet 22 is smaller in the example, which is shown in FIG. 6 and is narrower in the flow channel width L, than in the example which is shown in FIG. 7 and is wider in the flow channel width L. In other words, the amount of deformation of the flexible material is smaller in the example which is narrower in flow channel width L and hence the cross-sectional area of the flow channel is made smaller, which results in making flow resistance larger. In this way, when a narrow portion is formed in the middle of the flow channel, the flow resistance of the flow channel before and after the narrow portion can be determined at various values.

In FIG. 3, passive valve 15 and passive valve 16 of the flow channel selection mechanism can have their flow resistance values set thereto by the use of the principle described above. When the flow channel in passive valve 16 is made narrower than the flow channel in passive valve 15, the flow resistance value Y of passive valve 16 is made larger than the flow resistance value X of passive valve 15.

Further, in the description of the operation of the micro chip shown in FIG. 2, it has been described that the pressure of the liquid is gradually increased by the pressure supply unit. However, it is also possible to provide an operation to gradually increase the pressure of the liquid by providing an obstacle, whose flow resistance is made large, between the supply tank and the mixing tank flow channel.

Figure 8:
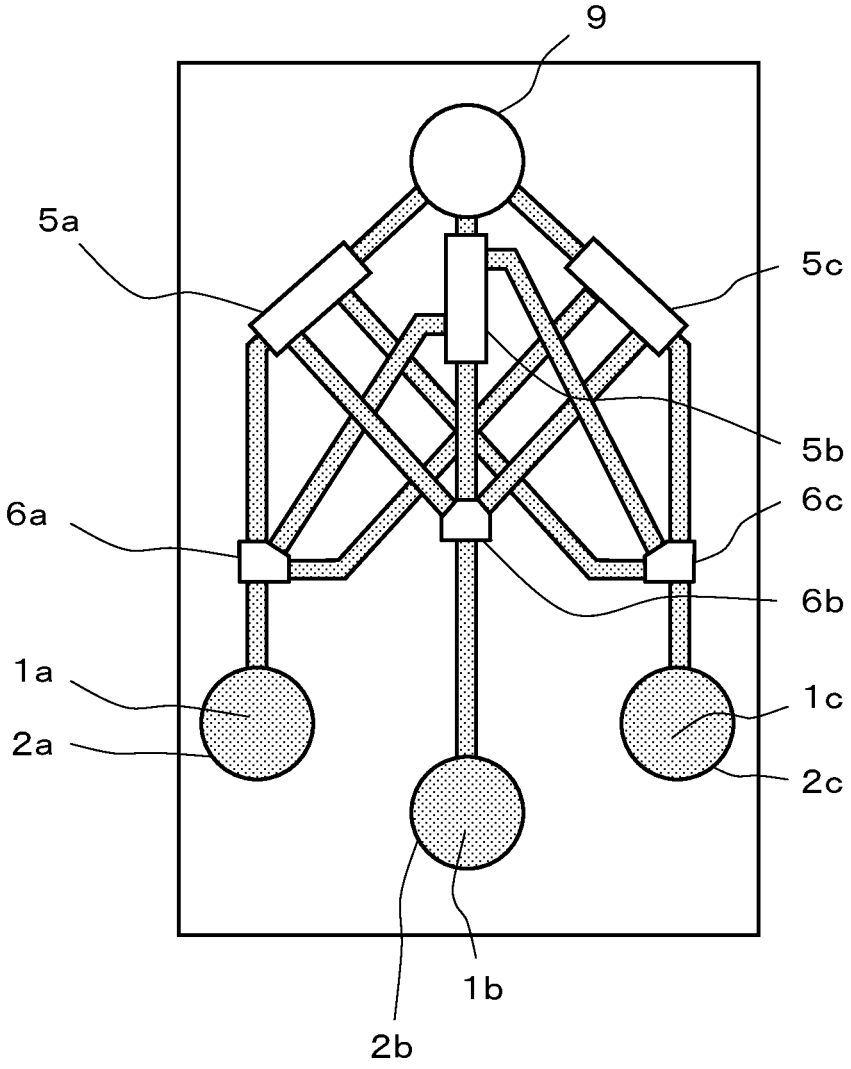
FIG. 8 is a schematic view to illustrate an exemplary embodiment of the present invention in a case where three mixing tank flow channels are provided.

In the exemplary embodiment of the present invention, which is shown in FIG. 2, is shown the case where the micro chip is provided with two mixing tank flow channels. However, even in the case where a micro chip is to be provided with three or more mixing tank flow channels, the micro chip can be realized in the same way. FIG. 8 is an exemplary example of the present invention in the case where a micro chip is provided with three mixing tank flow channels. The constituent elements denoted by the reference signs in FIG. 8 are the same as those in the exemplary example of the present invention shown in FIG. 2, so that their descriptions will be omitted here.

While preferred embodiments of the present invention have been described using specific terms, such description is for illustrative purposes only, and it is to be understood that changes and variations may be made without departing from the spirit or scope of the following claims.

DESCRIPTION OF REFERENCE NUMERALS AND SIGNS

1*a*, 1*b* liquid
2*a*, 2*b* supply tank
3*a*, 3*b* mixing tank flow channel
4*a*, 4*b* branch flow channel
5*a*, 5*b* valve
6*a*, 6*b* flow channel selection mechanism
7*a*, 7*b* hole
8*a*, 8*b* branch flow channel
9 mixing tank
10 micro chip
11 liquid
12 input flow channel
13, 14 output flow channel
15, 16 passive valve
17 branch point
18, 19, 20 sheet
21 micro chip
22, 23 sheet

24 flow channel
L flow channel width

What is claimed is:

1. A fluid mixing device comprising:

a mixing tank for mixing at least two liquids;

a plurality of supply tanks, one of which supply tanks is provided for each of said at least two liquids and supplies each of said liquids to the mixing tank;

mixing tank flow channels, each of which mixing tank flow channels connects a corresponding supply tank to the mixing tank;

a valve arranged in each of the mixing tank flow channels;

branch flow channels, each of which branch flow channels is connected to a corresponding mixing tank flow channel; and flow channel selection mechanisms respectively provided at a portion where each of the branch flow channels is connected to a corresponding one of the mixing tank flow channels, wherein each of the branch flow channels is connected from the flow channel selection mechanism in one of the mixing tank flow channels to the valve in another of the mixing tank flow channels, wherein in a case where pressure of the liquid supplied from one of the supply tanks does not reach a specified pressure, the flow channel selection mechanism, associated with the one supply tank, limits a flow of the liquid supplied from the one supply tank to a direction of the branch flow channels, and in a case where pressure of the liquid supplied from the one supply tank exceeds the specified pressure, the flow channel selection mechanism, associated with the one supply tank, allows a flow of the liquid supplied from the one supply tank also to a direction of the mixing tank via the corresponding mixing tank flow channel, and wherein when each valve has pressure applied thereto from the liquid passing through a corresponding one of the branch flow channels, the valve closes the corresponding mixing tank flow channel.

2. The fluid mixing device as claimed in claim 1, wherein the flow channel selection mechanism includes one input flow channel, which corresponds to a flow channel portion communicating with a supply tank side of the mixing tank flow channel, and at least two output flow channels, which correspond to a flow channel portion communicating with the branch flow channel and a flow channel portion communicating with a mixing tank side of the mixing tank flow channel, respectively, and wherein the output flow channels have flow resistances different from each other.

3. The fluid mixing device as claimed in claim 2, wherein the output flow channels are constructed in flow channel widths different from each other.

4. The fluid mixing device as claimed in claim 2, wherein the fluid mixing device is constructed by bonding at least two sheets to each other, and wherein the input flow channel and the output flow channels of the flow channel selection mechanism are constructed of portions in which the sheets are not bonded to each other.

5. The fluid mixing device as claimed in claim 1, wherein the flow channel selection mechanism is constructed of at least one flexible material.

6. The fluid mixing device as claimed in claim 1, wherein the fluid mixing device is constructed by bonding at least three sheets to each other and, wherein of the three sheets, a center sheet has a through hole formed by cutting.

7. A fluid mixing device, comprising:

a mixing tank for mixing a first liquid with a second liquid which is different from first liquid;

a first supply tank for supplying the first liquid;

a second supply tank for supplying second liquid;

a first mixing tank flow channel connected between the first supply tank and a first inlet of the mixing tank, the first mixing tank flow channel for feeding the first liquid from the first supply tank to the mixing tank;

a second mixing tank flow channel connected between the second supply tank and a second inlet of the mixing tank, the second mixing tank flow channel for feeding the second liquid from the second supply tank to the mixing tank;

a first valve located in the first mixing tank flow channel and arranged to prevent a flow from the mixing tank to the first supply tank;

a second valve located in the second mixing tank flow channel and arranged to prevent a flow from the mixing tank to the second supply tank;

a first flow channel selection mechanism located in the first mixing tank flow channel;

a second flow channel selection mechanism located in the second mixing tank flow channel;

a first branch flow channel connected to the first flow channel selection mechanism and to the second valve, thereby branching from the first mixing tank flow channel to the second mixing tank flow channel; and a second branch flow channel connected to the second flow channel selection mechanism and to the first valve, thereby branching from the second mixing tank flow channel to the first mixing tank flow channel, wherein, when pressure of the first liquid supplied from the first supply tank reaches a first specified pressure, the first flow channel selection mechanism limits the flow of the first liquid supplied from the first supply tank to only a direction of the first branch flow channel, and when the pressure of the first liquid supplied from the first supply tank exceeds the first specified pressure and a greater second specified pressure, the first flow channel selection mechanism also allows the flow of the first liquid supplied from the first supply tank to a direction of the mixing tank via the first flow channel.

8. The fluid mixing device as claimed in claim 7, wherein, the first valve comprises a diaphragm, and when the first valve has pressure applied thereto from the second liquid fed through the second branch flow channel, the first valve is deformed and communication between mixing tank and first mixing tank flow channel is blocked, the second valve comprises a diaphragm, and when the second valve has pressure applied thereto from the first liquid fed through the first branch flow channel, the second valve is deformed and communication between mixing tank and second mixing tank flow channel is blocked, the first flow channel selection mechanism defines a branch point between the first mixing tank flow channel and the first branch flow channel, the second flow channel selection mechanism defines a branch point between the second mixing tank flow channel and the second branch flow channel.

9. The fluid mixing device as claimed in claim 7, wherein, the first flow channel selection mechanism and the second flow channel selection mechanism each have one input flow channel corresponding to a flow channel portion that communicates with a supply tank side of a respective one of the first and second mixing tank flow channels and a plurality of output flow channels corresponding to a flow channel portion that communicate with a mixing tank side of the mixing tank flow channels and with a respective one of the first and second branch flow channels.

10. The fluid mixing device as claimed in claim 9, wherein, each flow channel selection mechanism further comprises a first passive valve arranged in a first of the output flow channels and a second passive valve arranged in a second of the output flow channels, and the first and second passive valves are different from each other in flow resistance value.

11. The fluid mixing device as claimed in claim 10, wherein, for the first flow channel selection mechanism, the first output flow channel is associated with the first flow channel and the second out flow channel is associated with the first branch flow channel, and the first passive valve has a first flow resistance value Y larger than a second flow resistance value X of the second passive valve.

12. The fluid mixing device as claimed in claim 7, wherein the first and second flow channel selection mechanisms each includes one input flow channel, which corresponds to a flow channel portion communicating with a supply tank side of the mixing tank flow channel, and at least two output flow channels, which correspond to a flow channel portion communicating with the corresponding one of the branch flow channels and a flow channel portion communicating with the mixing tank side of the mixing tank flow channel, respectively, and wherein the output flow channels have flow resistances different from each other.

13. The fluid mixing device as claimed in claim 12, wherein the output flow channels are constructed in flow channel widths different from each other.

14. The fluid mixing device as claimed in claim 12, wherein the fluid mixing device comprises at least two sheets bonded to each other, and wherein the input flow channel and the output flow channels of each flow channel selection mechanism are constructed of portions in which the sheets are not bonded to each other.

15. The fluid mixing device as claimed in claim 7, wherein each flow channel selection mechanism is constructed of at least one flexible material.

16. A fluid mixing device, comprising:

a mixing tank for mixing a first liquid with a second liquid;

first and second supply tanks for respectively supplying the first and second liquids;

a first mixing tank flow channel connected between the first supply tank and a first inlet of the mixing tank;

a second mixing tank flow channel connected between the second supply tank and a second inlet of the mixing tank;

a first valve located in the first mixing tank flow channel and arranged to prevent a flow from the mixing tank to the first supply tank;

a second valve located in the second mixing tank flow channel and arranged to prevent a flow from the mixing tank to the second supply tank;

first and second flow channel selection mechanisms located respectively in the first and second mixing tank flow channels;

a first branch flow channel branching from the first mixing tank flow channel to the second mixing tank flow channel by connection to the first flow channel selection mechanism and to the second valve; and a second branch flow channel branching from the second mixing tank flow channel to the first mixing tank flow channel by connection to the second flow channel selection mechanism and to the first valve, wherein, when pressure of the first liquid supplied from the second supply tank is below a first specified pressure, the first flow channel selection mechanism prevents a flow of the first liquid supplied from the first supply tank through both a direction of the first branch flow channel and a direction of the first flow channel, when the pressure of the first liquid supplied from the first supply tank reaches the first specified pressure, the first flow channel selection mechanism limits the flow of the first liquid supplied from the first supply tank to only the direction of the first branch flow channel, and when the pressure of the first liquid supplied from the first supply tank exceeds the first specified pressure and a greater second specified pressure, the first flow channel selection mechanism also allows the flow of the first liquid supplied from the first supply tank to the direction of the mixing tank via the first flow channel.

* * * * *